United States Patent [19]

McMurray

[11] 4,230,561

[45] Oct. 28, 1980

[54] METHOD AND APPARATUS FOR SEPARATING CLAY FROM COAL FINES

[76] Inventor: Russell L. McMurray, R.R. #2, Box 213, Du Quoin, Ill. 62832

[21] Appl. No.: 26,428

[22] Filed: Apr. 2, 1979

[51] Int. Cl.[3] ..... B03B 5/54

[52] U.S. Cl. ..... 209/464; 209/173; 209/208

[58] Field of Search ..... 209/172.5, 173, 155, 209/208, 461–464, 18

[56] References Cited

U.S. PATENT DOCUMENTS

| | | | |
|---|---|---|---|
| 839,542 | 12/1906 | Blaisdell | 209/463 X |
| 2,083,674 | 6/1937 | Smith | 209/155 X |
| 2,196,451 | 4/1940 | Holzer | 209/17 |

*Primary Examiner*—Ralph J. Hill

*Attorney, Agent, or Firm*—Woodard, Weikart, Emhardt & Naughton

[57] ABSTRACT

An apparatus for use in separating clay from coal fines comprising a hopper having a sloped rear wall, a baffle mounted to the hopper and extending downwardly, a conveyor positioned along the rear wall of the hopper, and an overflow port located in the side walls between the baffle and the rear wall of the hopper. In particular embodiments the hopper includes a horizontal baffle extending from the first baffle and positioned below the overflow ports and an apron extending outwardly of the hopper from the rear wall. A method for separating a mixture of clay particles and coal fines is also described herein.

10 Claims, 3 Drawing Figures

METHOD AND APPARATUS FOR SEPARATING CLAY FROM COAL FINES

BACKGROUND OF THE INVENTION

1. Field of the Invention

The present invention relates to apparatus and methods for the treatment of coal fines, and more particularly to a method and apparatus for separating clay particles from the other particles present in coal fines. The present invention further relates to the agglomeration of coal particles, and the pre-treatment of such particles for that process.

2. Description of the Prior Art

Various apparatus and methods are known in the prior art for treating coal fines or other mixtures including coal particles. In general, these prior art methods and apparatus are directed to separating and/or washing of the material, in contrast to the present invention which has the particular purpose of removing the clay particles from the coal mixture.

In U.S. Pat. No. 2,196,451, issued to Holzer on Apr. 9, 1940, there is shown a method and apparatus for separating, washing and grading lump material. The apparatus of the Holzer patent includes a verticle tower into which the lump material is delivered. The tower provides a head of the material to force the material from the bottom of the tower into the remaining portion of the apparatus. The apparatus is filled with a liquid medium which has a greater specific gravity than the coal or other lump material to cause such material to float in the liquid medium. The floating material is moved along an open mesh and permitted to pass therethrough in a grading operation, while heavier materials settle onto a belt conveyor for removal. The Holzer apparatus and method utilize the special medium to provide for floating of the coal particles, and further uses dry or as-received coal which is introduced into the hopper below the fluid level. In contrast, the present invention utilizes a water suspension of coal fines, typically fourteen mesh or smaller, which aqueous solution is introduced into the hopper above the fluid level. The Holzer apparatus specifically provides for maintaining the medium in agitation. The present invention is specifically intended to provide for the water in the hopper remaining very calm to permit the separation of the clay particles from the heavier than water particles.

A typical mechanical classifier is disclosed in U.S. Pat. No. 1,306,188, issued to Marcy on June 10, 1919. In accordance with the Marcy patent, the crushed ore or other material is delivered into the hopper below the liquid level and mixers operate to provide constant agitation within the hopper. A chain driven conveyor is provided for removing the settled particles. In contrast to the Marcy apparatus and method, the present invention separates the clay particles from the other components of coal fines by permitting the clay to remain suspended in the water and be removed with the overflow from the hopper.

The particular features of the present apparatus and method provide for simple, inexpensive and efficient separation of clay particles from the other components of coal fines. The present invention is particularly useful in connection with a coal agglomeration process, the clay particles desirably being removed to prevent their interference with the agglomeration process.

SUMMARY OF THE INVENTION

In one embodiment, the present invention relates to an apparatus comprising a hopper having a rear wall extending at an angle of less than about 45° from horizontal, and a baffle mounted to the hopper and extending downwardly toward the bottom of the hopper. Means are provided for feeding a water suspension of the coal fines and clay particles into the hopper in front of the baffle, and a conveyor is positioned adjacent the rear wall of the hopper to remove settled out particles from the suspension. One or more overflows are located between the baffle and the rear wall of the hopper to receive the suspended clay particles and overflow water. In another aspect, the present invention relates to a method for separating a mixture of clay particles and coal fines which comprises feeding an aqueous suspension of the mixture into a hopper apparatus and permitting the particles other than the clay particles to settle out to the bottom of the hopper.

It is an object of the present invention to provide a hopper apparatus for separating clay particles from coal fines.

Another object of the present invention is to provide a hopper apparatus which is simple and inexpensive in construction, and which provides for the efficient removal of clay particles from coal fines.

It is a further object of the present invention to provide for the separation of sulphur and other particularly heavy materials from coal fines, while also separating the clay particles as a third component.

It is another object of the present invention to provide a method for the separation of clay particles from coal fines, and which further has the above advantages and purposes associated therewith.

Further objects and advantages of the present invention will become apparent from the description of the preferred embodiment which follows.

DESCRIPTION OF THE PREFERRED EMBODIMENT

The apparatus and method of the present invention provides for the simple and efficient removal of clay particles from coal fines. In particular, an aqueous solution of the coal fines including the clay particles is fed to a hopper apparatus designed to provide a calm environment to facilitate settling out of the heavier coal and other particles. While these particles settle out from the water, the clay particles remain in suspension for a longer time and pass from the hopper with the overflow liquid.

Figure 1:
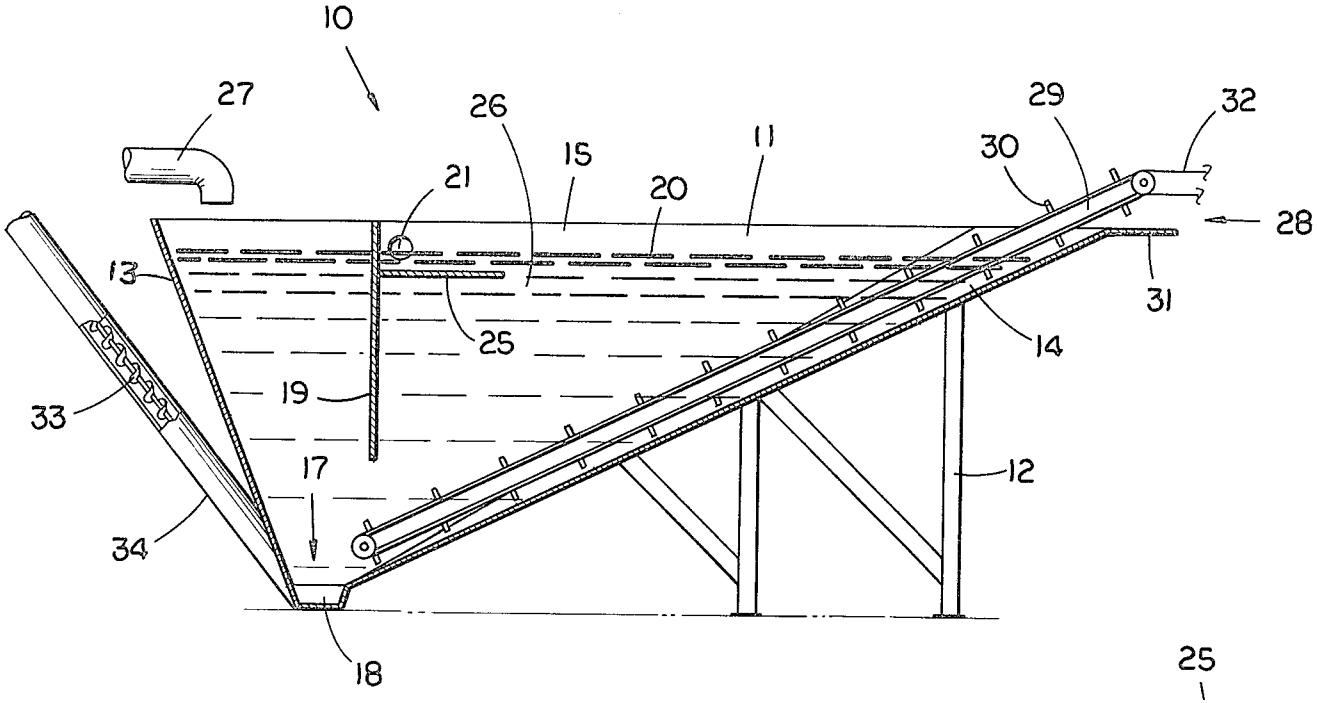
FIG. 1 is a side, cross-sectional view of the hopper apparatus of the present invention.
Figure 3:
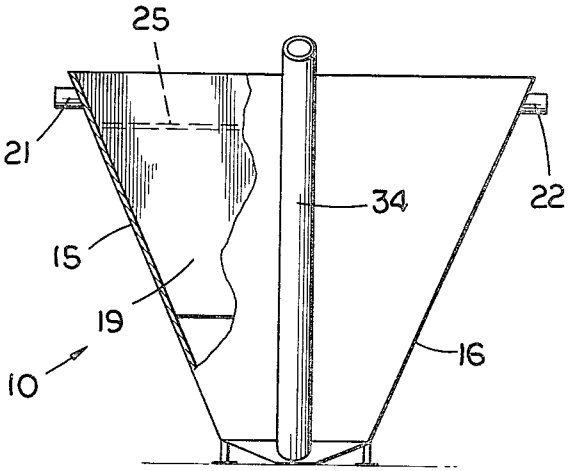
FIG. 3 is a front and elevational view of the hopper apparatus of the present invention.
Figure 2:
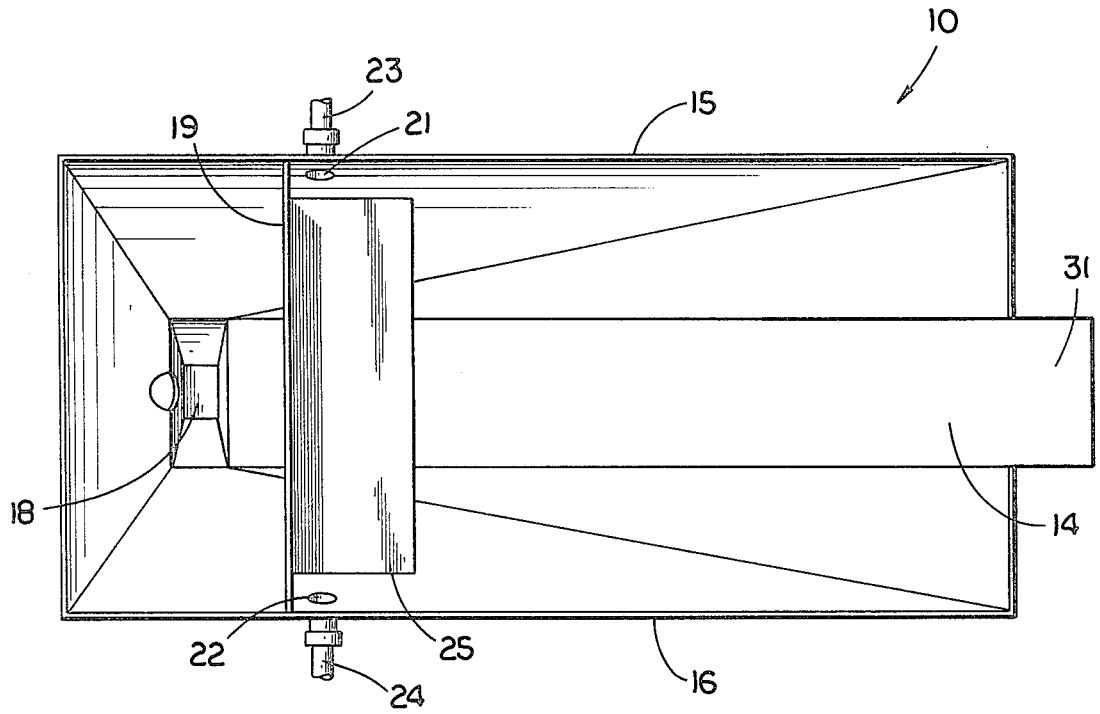
FIG. 2 is a top, plan view of the hopper apparatus of the present invention, the hopper being shown with the auger and belt conveyor removed.

Referring in particular to the drawings, there is shown a hopper apparatus 10 constructed in accordance with the present invention. Hopper apparatus 10 includes a hopper 11 and suitable supporting framework 12. Hopper 11 includes a steeply-inclined front wall 13, a gradually inclined rear wall 14 and side walls, 15 and 16. As shown in FIG. 3, the side walls preferably diverge upwardly. Hopper 11 further includes a bottom 17 which preferably includes converging wall portions, such as 18, to provide a reduced area for collection of heavy particles settling out from the liquid in the hopper.

Mounted to the hopper is a first baffle 19. First baffle 19 extends downwardly toward bottom 17 but is spaced apart therefrom. First baffle 19 should extend upwardly at least as high as the liquid level 20, and therefore at least as high as the bottom of the overflow port 21 in the side of the hopper. Baffle 19 may be mounted to hopper 11 in any suitable manner, particularly as by welding the edges of the baffle to the opposed sides of the hopper.

At least one overflow port is located in a side of the hopper between the first baffle 19 and the rear wall 14 of the hopper. Preferably a first overflow port 21 is located in one side 15 and a second overflow port 22 is located in the opposite side 16. Overflow lines 23 and 24 are connected to and communicate with the overflow ports 21 and 22 respectively.

A second baffle 25 is mounted to the hopper 11 and extends in a generally horizontal plane between the first baffle 19 and the rear wall 14. The second baffle 25 may be attached or mounted to the hopper in any conventional manner, and preferably is attached by welding to the sides of the hopper as well as the first baffle 19. The overflow ports are preferably positioned above the second baffle 25, and most preferably are located near the junction of first baffle 19 and second baffle 25 to provide overflow of the water 26 in the hopper at an area of minimal agitation. Moreover, by removal of the water at the preferable location, a minimum of agitation is presented into the water as a result of the flow from the hopper.

Means are provided for feeding the aqueous mixture of coal fines including clay particles into the hopper between front wall 13 and the first baffle 19. Means for feeding the aqueous mixture are well known in the art, and as used in the present invention may comprise any of the conventional means. Most preferably, the mixture is fed from the feed means 27 such that the mixture is fed to the hopper 11 at a location above the liquid level 20. Alternatively, the mixture may be fed to the hopper below the liquid level, but in either event it is most desirable to add the mixture near the top of the hopper to maximize the time during which the mixture remains in the hopper, thereby permitting maximum separation of the clay and the other components of the coal fines.

Positioned against the rear wall of the hopper is a conveyor for moving settled particles out of the hopper. The conveyor is positioned adjacent and extends along the rear wall. The conveyor 28 may be any of a variety of conventional types, but preferably comprises a chain-driven flight conveyor 29 including numerous transverse blade members 30. The conveyor is located to deliver the settled particles from the hopper onto the extension 31, from which the particles are collected by suitable means and transported for further processing as required. Suitable drive means 32 are provided for moving the conveyor as desired. If a conveyor is utilized which includes a continuous belt through which the particles may not settle, then the conveyor is naturally moved to cause the upper belt to transfer the settled particles upwardly from the hopper. However, a conveyor which does not include a continuous belt between the blade members, but rather joins the blade members by chains or other means is preferably used so that the particles may settle through the upper portion of the conveyor. In this manner, the particles are permitted to settle onto the rear wall 14, and the conveyor may then be moved to cause the blades on the lower portion of the conveyor to move the materials upwardly along the rear wall and to the extension 31.

An auger 33 is preferably provided to remove the heaviest, settled particles from the bottom 17 of the hopper. The auger is suitably provided by the attachment of an enclosure 34 to the hopper to have an interior communicating with the interior of the hopper at approximately the bottom 17. The auger is located within the enclosure 34 and is driven by suitable means to deliver the solid particles, preferably devoid of fluid material, from the hopper to a separate collection point.

The described apparatus of the present invention provides a hopper which is well suited to separating clay and other particles from coal fines. In a particular application, the hopper is particularly suited to the removal of clay from coal fines in the procedure of agglomerating coal particles since the clay is typically the greatest deterrent to successful and efficient pelletizing of the coal particles. This method is preferably accomplished with a suspension of the mixture having at least about fifty percent water by weight. As a particular example in this regard, and referring to the hopper of the present invention, the water, solids and clay that are minus 14 mesh in size enter the hopper at the top between the front wall 13 and baffle 19. Baffle 19 causes the material to move to approximately the bottom of the hopper and then forward the back wall 14.

The clay remains suspended in the water for a greater period of time than the other solids present in the suspension, particularly when the particles are sized as described. The very fine coal particles, typically 325 mesh and smaller, will settle very slowly, but since they have been thoroughly wetted they will sink in the still or almost still water provided by the hopper design. The avoidance of significant water turbulence is provided by the hopper design by virtue of the gradually inclined rear wall 14, the baffles 19 and 25, and the location of the overflow ports 21 and 22. The fine coal particles will settle through the water to the conveyor which thereafter moves the particles adjacent rear wall 14 and eventually out of the hopper. The provision of the rear wall 14 having a slope of preferably less than about 45° from horizontal facilitates the settling and removal of the coal particles, and particularly with minimal agitation of the water. The water and suspended clay particles continue to move through the hopper to the overflow ports 21 and 22.

As described, the conveyor is preferably a chain-driven flight conveyor which permits the particles to settle therethrough onto the rear wall 14. The conveyor is therefore driven in a counterclockwise direction in the figures to cause the flight immediately adjacent rear wall 14 to move upwardly along the wall and to the top of the conveyor. The coal particles are thereby swept up the rear wall and to the extension 31 of the hopper, from which they are conveniently moved to the hopper of a solids feeder for further handling and treatment. This manner of rotation of the conveyor and the provision of the conveyor with wide, deep flights helps to neutralize the water turbulence. The conveyor is moved relatively slowly to avoid stirring the water. The extension or apron 31 is provided to hold the solids long enough to let the trapped water flow back into the hopper. Further, a fine fresh-water spray may be used at this point to further cleanse the solids of the dirty water.

The auger conveyor previously described is preferably a screw-type, but the conveyor may be of other types suitable for this application. As the mixture enters the hopper at the top, the heavier particles, such as sulphur, will settle downwardly at a faster rate than the lighter coal particles. The hopper design will cause these first-settling particles to collect at the bottom 17, from which the auger or other type conveyor can conveniently remove these particles from the hopper. In this manner, the hopper provides for the separation of the coal fines from the heavier particles at the bottom and from the clay particles which pass with the water through the overflow ports. The heavy particles such as sulfur are typically discharged as waste.

As shown in the figures, the rear wall preferably includes a central, rectangular wall portion, and also a pair of upwardly-widening triangular wall portions on either side of the rectangular wall portion. The rear wall portions thereby define a channel having the rectangular wall portion at the bottom. The conveyor preferably comprises a flight conveyor having numerous, transverse blade members, the blade members being complementary in shape with the central, rectangular wall portion of the rear wall and being received in the channel defined by the rear wall. Also shown in the drawings, the baffle 19 extends vertically downward within the hopper and is positioned in a plane which is spaced horizontally from the front wall. In other words, the baffle 19 is positioned so that the plane in which it lies does not intersect the front wall. The second baffle 25 extends horizontally directly below the overflow port 21.

Various alterations in the preferred embodiment of the hopper are contemplated and are to be considered included within the scope of the present invention. A particular variation would provide for the verticle adjustment of baffle 19. Such adjustment may be provided in a number of familiar ways. For example, the baffle may be received within channels located on the opposed sides of the conveyor and holes through the baffle or portions extending therefrom may be used to fix the baffle at a desired verticle position. Variations in the shape of the hopper are also contemplated, although the steeply inclined front wall and gradually inclined rear wall are considered to be particularly preferred. The tank naturally must be a water tight unit and the supporting framework should be configured to adequately support the hopper and the considerable weight of the fluid received therein.

I claim:

1. An apparatus for use in the separation of clay from coal fines which comprises:

a hopper including a bottom, a front wall, side walls and a rear wall, the side walls diverging upwardly, the rear wall having the top and extending upwardly from the bottom at an angle to horizontal of less than about 45 degrees, the rear wall including a central, rectangular wall portion and a pair of upwardly-widening triangular wall portions on either side of the rectangular wall portion, thereby defining a channel having the rectangular wall portion at the bottom;

a first baffle mounted to said hopper and extending vertically downward toward the bottom of said hopper, said first baffle being positioned in a plane spaced horizontally from the front wall;

a second, horizontal baffle mounted to said hopper;

a conveyor positioned adjacent and extending along the rear wall of said hopper from approximately the bottom of said hopper to above the top of the rear wall of said hopper, said conveyor comprising a flight conveyor having numerous, transverse blade members, the blade members being complementary in shape with the central, rectangular wall portions of the rear wall and being received in the channel defined by the rear wall;

drive means for driving said conveyor;

feed means for feeding a water suspension of coal fines containing clay particles into said hopper between the front wall of said hopper and said baffle;

an apron extending outwardly of said hopper from the rear wall of said hopper; and overflow means for receiving water suspension of clay and directing the suspension from said hopper, said overflow means including at least one overflow port located in one of the side walls of said hopper between said first baffle and the rear wall of said hopper, said second baffle extending directly below the overflow port, at least a portion of the overflow port being located below the top of the rear wall of said hopper, said first baffle extending upwardly at least as high as the bottom of the overflow port.

2. The apparatus of claim 1 and further including auger means for removing said material settled onto the bottom of said hopper, said auger means including an auger having one end positioned adjacent the bottom of said hopper.

3. The apparatus of claim 1 and further including means for adjusting the vertical position of said baffle.

4. A method for separating a mixture of clay particles and coal fines which comprises the steps of:

a. providing a hopper apparatus including a hopper having a bottom and a downwardly extending baffle having a bottom edge spaced above the bottom of the hopper, the hopper including a front wall and including a rear wall extending upwardly from the bottom at an angle of less than about 45 degrees to horizontal;

b. feeding an aqueous suspension of the mixture into the hopper apparatus between the front wall of the hopper and the baffle, whereby the aqueous suspension is forced downwardly toward the bottom of the hopper, the aqueous suspension being fed at a sufficiently slow rate to permit settling out of coal fines toward the bottom of the hopper while the clay particles remain suspended in the water;

c. removing the settled out coal fines by a conveyor positioned adjacent the rear wall of the hopper; and d. removing the water and suspended clay particles from about the top of the hopper at a location between the baffle and the rear wall of the hopper.

5. The method of claim 4 in which step b. includes preparing a suspension of the mixture having at least about 50% water by weight.

6. The method of claim 4 in which step b. comprises feeding the aqueous suspension into the hopper at a location above the liquid level in the hopper.

7. The method of claim 6 in which step b. includes preparing a suspension of the mixture having at least about 50% water by weight.

8. The method of claim 7 in which step b. includes obtaining a mixture of clay particles and coal fines having particle sizes of not greater than about 14 mesh size.

9. The method of claim 7 and which further includes removing with an auger the particles settled onto the bottom of the hopper, the auger having one end positioned adjacent the bottom of the hopper.

10. The method of claim 9 in which the hopper includes a second baffle spaced apart from and extending horizontally between the first baffle and the rear wall of the hopper, step d. comprising removing the water and suspended clay particles at a location above the second baffle.

* * * * *